US008666264B2

(12) United States Patent
Shimazu et al.

(10) Patent No.: US 8,666,264 B2
(45) Date of Patent: Mar. 4, 2014

(54) IMAGE FORMING APPARATUS AND TONER REFILLING METHOD THEREFOR

(75) Inventors: Fumio Shimazu, Hachioji (JP); Tetsuya Abe, Tama (JP); Hideki Ando, Hamura (JP); Hiroaki Ootsubo, Higashimurayama (JP); Chihiro Toyama, Hachioji (JP); Yuichiro Iegaki, Kodaira (JP)

(73) Assignees: Casio Computer Co., Ltd., Tokyo (JP); Casio Electronics Manufacturing Co., Ltd., Saitama (JP)

( * ) Notice: Subject to any disclaimer, the term of this patent is extended or adjusted under 35 U.S.C. 154(b) by 260 days.

(21) Appl. No.: 13/150,419

(22) Filed: Jun. 1, 2011

(65) Prior Publication Data

US 2011/0299860 A1 Dec. 8, 2011

(30) Foreign Application Priority Data

Jun. 3, 2010 (JP) ..... 2010-127637
Jun. 8, 2010 (JP) ..... 2010-131100
Jun. 17, 2010 (JP) ..... 2010-138684
Jun. 21, 2010 (JP) ..... 2010-140834

(51) Int. Cl.
*G03G 15/00* (2006.01)

(52) U.S. Cl.
USPC ..... 399/12; 399/13; 399/27; 399/30; 399/61; 399/62; 399/106; 399/258; 399/262; 399/263

(58) Field of Classification Search
USPC ..... 399/12, 13, 263
See application file for complete search history.

(56) References Cited

U.S. PATENT DOCUMENTS 5,652,947 A * 7/1997 Izumizaki ..... 399/58
6,347,199 B1 2/2002 Morihara (Continued)

FOREIGN PATENT DOCUMENTS

JP 2-020888 A 1/1990
JP 4-034480 A 2/1992

(Continued)

OTHER PUBLICATIONS

Japanese Office Action dated Nov. 13, 2012 (and English translation thereof) in counterpart Japanese Application No. 2010-140834.

(Continued)

*Primary Examiner* — David Gray
*Assistant Examiner* — Geoffrey Evans
(74) *Attorney, Agent, or Firm* — Holtz, Holtz, Goodman & Chick

(57) ABSTRACT

In a new printer, a toner cartridge is mounted in the state where there is no toner in a reserve tank, and toner of the amount of filling toner D therein is supplied with the amount of full accommodation toner E for filling up the reserve tank by a toner supply mechanism. The toner of the amount of remaining surplus toner F remains in the toner cartridge. The amount of toner consumption G is measured by a dot counter during a printing execution. In the case where a toner density sensor detects a toner decreasing, the toner is supplied to a developing unit from the reserve tank. When it becomes G>F, it display-informs a user of "toner cartridge exchange is allowed". Hereby, it enables to exchange the toner cartridge without stopping operation of the main body of the image forming apparatus using a two-component developer.

8 Claims, 6 Drawing Sheets

(56) References Cited

U.S. PATENT DOCUMENTS

| | | | | |
|---|---|---|---|---|
| 7,110,707 | B2 * | 9/2006 | Nishitani | 399/258 |
| 7,218,871 | B2 * | 5/2007 | Ogata | 399/27 |
| 7,949,265 | B2 * | 5/2011 | Sakita et al. | 399/27 |
| 8,150,277 | B2 | 4/2012 | Takiguchi | |
| 8,184,997 | B2 * | 5/2012 | Hadano | 399/27 |
| 8,238,767 | B2 * | 8/2012 | Kawarazuka et al. | 399/27 |
| 8,238,796 | B2 * | 8/2012 | Yoshida et al. | 399/258 |
| 8,442,420 | B2 * | 5/2013 | Shimazu | 399/302 |
| 8,526,834 | B2 * | 9/2013 | Kawai | 399/12 |
| 8,543,015 | B2 * | 9/2013 | Tokuno et al. | 399/12 |
| 8,571,426 | B2 * | 10/2013 | Kubota et al. | 399/27 |
| 2004/0052538 | A1 * | 3/2004 | Yugeta et al. | 399/27 |
| 2005/0265738 | A1 * | 12/2005 | Ogata | 399/27 |
| 2009/0047044 | A1 * | 2/2009 | Sakita et al. | 399/258 |
| 2010/0046966 | A1 * | 2/2010 | Ito | 399/27 |
| 2010/0202788 | A1 * | 8/2010 | Suda | 399/27 |
| 2011/0013952 | A1 * | 1/2011 | Shimazu | 399/302 |
| 2013/0136504 | A1 * | 5/2013 | Kawashima | 399/258 |
| 2013/0188973 | A1 * | 7/2013 | Kusumoto | 399/27 |
| 2013/0209140 | A1 * | 8/2013 | Murakami et al. | 399/258 |
| 2013/0216243 | A1 * | 8/2013 | Kouroku | 399/12 |

FOREIGN PATENT DOCUMENTS

| | | | | |
|---|---|---|---|---|
| JP | 7-104573 | A | | 4/1995 |
| JP | 11-327280 | A | | 11/1999 |
| JP | 2002-148926 | A | | 5/2002 |
| JP | 2003-029518 | A | | 1/2003 |
| JP | 2005-227710 | A | | 8/2005 |
| JP | 2005-241868 | A | | 9/2005 |
| JP | 2005-266551 | A | | 9/2005 |
| JP | 2005-338332 | A | | 12/2005 |
| JP | 2006-113137 | A | | 4/2006 |
| JP | 2006-171158 | A | | 6/2006 |
| JP | 2006251402 | A | * | 9/2006 |
| JP | 2006251404 | A | * | 9/2006 |
| JP | 2007-322956 | A | | 12/2007 |
| JP | 2009-210743 | A | | 9/2009 |
| JP | 2009-276666 | A | | 11/2009 |

OTHER PUBLICATIONS

Japanese Office Action dated Nov. 6, 2012 (and English translation thereof) in counterpart Japanese Application No. 2010-138684.

Japanese Office Action dated Nov. 13, 2012 (and English translation thereof) in counterpart Japanese Application No. 2010-131100.

* cited by examiner

IMAGE FORMING APPARATUS AND TONER REFILLING METHOD THEREFOR

CROSS-REFERENCE TO RELATED APPLICATION

This application claims the benefit of Japanese Patent Application No. 2010-127637 filed Jun. 3, 2010, Japanese Patent Application No. 2010-131100, filed Jun. 8, 2010, Japanese Patent Application No. 2010-138684, filed Jun. 17, 2010, and Japanese Patent Application No. 2010-140834, filed Jun. 21, 2010, all of the entire disclosures of which are incorporated by reference herein.

FIELD

This application relates generally to an image forming apparatus using a two-component developer, and more particularly, to an image forming apparatus and a toner refilling method for the image forming apparatus enabling an exchange of a toner cartridge without stopping an operation of a main body of the image forming apparatus.

BACKGROUND

Conventionally, there is an image forming apparatus of an electrophotographic manner. This image forming apparatus, generally, charges a photosensitive drum uniformly to initialize, and forms an electrostatic latent image on this photosensitive drum by optical writing. Then, a toner image is generated from the electrostatic latent image, and the toner image is directly or indirectly transferred to a transfer material such as a sheet and affixed by a fixing unit.

For a developing device as above, since toner is consumed as the electrostatic latent image is developed to the toner image, the toner is supplied to the developing device continuously in order to maintain an adequate development performance. In many cases, a toner cartridge of an attachment-and-detachment exchange type is used for the toner supply.

As the toner supply from the toner cartridge is discharged, the toner in the toner cartridge is used up in due time, then the toner cartridge becomes empty. The toner cartridge which becomes empty would need to be exchanged for new one in order to continue operating.

In the exchange of the toner cartridge, the toner cartridge is provided with a toner residual quantity detection sensor for example, when the toner residual quantity detection sensor detects out of toner in the toner cartridge, an exchange of the toner cartridge request is relayed to a user by a display device or a warning light of operation panel.

Moreover, with respect to this informing of the exchange time of the toner cartridge, a known technology of a dot counter may be used in some cases. The dot counter calculates the amount of toner consumption based on the exposure time of a recording head which has applied an optical writing to a photoreceptor (=area of the light illuminated to the photoreceptor), utilizing that the toner moves to the part where the optical writing is applied to the photoreceptor and forms an image, and the dot counter calculates the out of toner in the toner cartridge. According to this method, it is also possible to omit the toner residual quantity detection sensor.

Then, when knowledge of the exchange of the toner cartridge is known, it is a common practice for the user to stop the operation of the image forming apparatus, exchange the old and new toner cartridge, turns on operation switch of the image forming apparatus, and resume an image forming process.

In the case where the user does not store the toner cartridge for exchanging an old toner cartridge for a new toner cartridge, the old and new toner cartridge cannot be exchanged immediately. In such case, it is not possible to use the image forming apparatus, and a user's operativity may be reduced.

In both the cases of once stopping the operation of the image forming apparatus as described above and the case in which the image forming apparatus cannot be used because the new toner cartridge is not stored, it remains that the user's operativity is reduced.

Unexamined Japanese Patent Application KOKAI Publications No. 2003-029518 and No. 2005-241868 disclose an image forming apparatus. The image forming apparatus comprises a configuration which supplies the toner to the reserve tank from the toner cartridge capable of fitting to and removing from the main body of the image forming apparatus, and conveys the toner from the reserve tank to the developing equipment, so that exchange of the toner cartridge may be possible without stopping the operation of the main body of the image forming apparatus.

Moreover, as an example of one having the reserve tank, there is an image forming apparatus proposed in Unexamined Japanese Patent Application KOKAI Publication No. 2006-113137. This image forming apparatus is considered a downsizing of entire apparatus, can be applied to a color image forming apparatus of a tandem type, and proposes a developer conveying apparatus which can move easily between an image forming operating position where a developer is conveyed to the developing equipment and a maintenance work position where an extraction work of the developing equipment can be done.

According to Unexamined Japanese Patent Application KOKAI Publications No. 2003-029518 and No. 2005-241868 described above, the toner cartridge and the reserve tank are located in the position separated from the developing equipment, in the color image forming apparatus having a developing device of a rotary type and the color image forming apparatus of a tandem type.

In such configuration in which the reserve tank is provided between the toner cartridge and a development section, there is a problem to be solved that a toner conveying apparatus becomes large-sized since the reserve tank and developing equipment are located in separate positions.

Further, the distance of toner conveyance increases as the toner conveying apparatus is disposed between, the reserve tank and the developing equipment, there is a problem to secure a quick responsiveness of the toner supply into the development section.

On the other hand, the technique disclosed in Unexamined Japanese Patent Application KOKAI Publication No. 2006-113137 intends to downsize the developer conveying apparatus. However, there is no disclosure that it is possible to exchange the toner cartridge without stopping operation of the main body of the image forming apparatus. Therefore, even if the developer conveying apparatus is downsized, there remains the problem to be solved.

SUMMARY

The present invention is made in view of the fact described above, and has an object to provide an image forming apparatus and a toner refilling method for the image forming apparatus enabling a smooth exchange of a toner cartridge without stopping operation of a main body of the image forming apparatus using a two-component developer and without occurring any image abnormality.

In order to achieve the object of the present invention described above, a toner refilling method is provided for an image forming apparatus which comprises (i) a reserve tank which is integrally provided in a main body of the image forming apparatus and which does not include a detection sensor that directly detects whether or not a toner exists inside the reserve tank; (ii) a two-component developing equipment which is detachably connected to the reserve tank and which develops an image on a photoreceptor with a two-component developer for printing; (iii) a toner density sensor which detects a density of the toner in the two-component developing equipment; and (iv) a toner cartridge which is detachably connected to the reserve tank and which supplies the toner to the two-component developing equipment via the reserve tank, wherein the toner cartridge does not include a detection sensor that directly detects whether or not the toner exists inside the toner cartridge. The toner refilling method according to the present invention is configured to include processes of receiving a notification from a detecting device indicating that the toner cartridge which is an original toner cartridge is mounted on the reserve tank; starting a printing in accordance with the notification of the mounting of the original toner cartridge; determining an amount of remaining surplus toner remaining in the original toner cartridge by subtracting an amount of full accommodation toner for filling up the reserve tank from an amount of charged toner in the original toner cartridge; acquiring an amount of toner consumption using a dot counter which counts total printing data from a printing start to a current state; determining whether or not the amount of the toner consumption exceeds the amount of the remaining surplus toner, and when it is determined that the amount of the toner consumption exceeds the amount of the remaining surplus toner, exchange-informing a user to exchange the original toner cartridge with a new toner cartridge while operating the main body of the image forming apparatus; waiting for a notification of detection of the new toner cartridge which replaces the original toner cartridge; and informing the user of an amount of toner which can be consumed after the exchange to the new toner cartridge and proceeding with the printing, when the notification of detection of the new toner cartridge is received.

In the toner refilling method of the image forming apparatus according to the present invention configured as described above, it is configured to further include the process of calculating, when possible-informing the user of the amount of toner which can be consumed, the amount of toner consumption in an exchange period supplied to the developing unit from the reserve tank within the time from an exchange-informing to a possible-informing, and informing a value obtained by subtracting "the amount of toner consumption in an exchange period" from "the amount of charged toner" as the amount of toner which can be consumed.

In the toner refilling method of the image forming apparatus according to the present invention configured as described above, it is configured to further include the process of informing the user of an advance notice of out of toner and, proceeding with the printing, when the amount of toner consumption is close to the amount of full accommodation toner without receiving the notification of detecting the new toner cartridge from the detecting device.

In the toner refilling method as described above, the processes further include: driving a reserve tank motor for toner supply of the reserve tank when an output of the toner density sensor decreases; and monitoring whether or not the output of the toner density sensor is recovered, proceeding with the printing in the case of being recovered, and forcibly stopping the operation of the image forming apparatus in the case of not being recovered.

In order to achieve the object of the present invention described above, an image forming apparatus according to the present invention is an image forming apparatus for printing on a paper. The image forming apparatus for printing on a paper is configured to include a reserve tank that is integrally provided in a main body of the apparatus and that does not include a detection sensor which directly detects whether or not a toner exists inside the reserve tank; a two-component developing equipment that is detachably connected to the reserve tank and that develops an image on a photoreceptor with a two-component developer for printing; a toner density sensor that detects a density of the toner in the two-component developing equipment; a toner cartridge that is detachably connected to the reserve tank and that supplies the toner to the two-component developing equipment via the reserve tank, wherein the toner cartridge does not include a detection sensor which directly detects whether or not the toner exists inside the toner cartridge; a detecting device that detects a new toner cartridge being mounted; a consumed toner amount calculation unit that calculates an amount of consumption of the toner consumed by the two-component developing equipment for printing based on printing data; a control device that determines necessity of exchange of the new toner cartridge in the image forming apparatus according to the amount of consumption of the toner calculated by the consumed toner amount calculation unit; and a storage unit that stores an amount of remaining surplus toner remaining in the new toner cartridge, wherein the amount of remaining surplus toner is a difference between an amount of charged toner of the new toner cartridge mounted on the reserve tank and an amount of full accommodation toner from the new toner cartridge which fills up the reserve tank. Furthermore, the control device of the image forming apparatus is configured to display on a display device as consumable information, in response to a notification from the detecting device that the new toner cartridge is mounted on the reserve tank, and while the image is being developed on the photoreceptor by the two-component developing equipment, an indication of an amount of toner that is consumable until a next exchange of the new toner cartridge; control a printing operation of the image forming apparatus according to a user instruction; obtain the amount of toner consumption calculated by the consumed toner amount calculation unit as an amount of toner used in the two-component developing equipment from a time that the new toner cartridge is mounted to a current state; and display on the display device, while the image is developable on the photoreceptor by the two-component developing equipment, and when the amount of toner consumption exceeds the amount of remaining surplus toner stored in the storage unit, an instruction informing the user of exchange information that encourages the user to exchange the mounted new toner cartridge with another new toner cartridge.

In the image forming apparatus according to the present invention configured as described above, the consumable information may be information showing a difference between the amount of full accommodation toner and an amount of toner consumption in an exchange period, wherein the toner consumption in the exchange period is the amount of toner supplied to the developing equipment from the reserve tank determined by a difference based on the exchange information and the consumable information.

In the image forming apparatus according to the present invention configured as described above, the control device may further display on the display device a user instruction of an advance notice of out of toner when a difference between the amount of consumption of the toner and the amount of full accommodation toner is equal to or less than a predetermined reference value and without receiving a notification of detecting an exchange from the mounted toner cartridge with the another new toner cartridge is notified.

In the image forming apparatus according to the present invention configured as described above, it is configured to further include a toner density sensor coupled to the two-component developer, the toner density sensor being configured to detect toner density of the two-component developer. The reserve tank may include a fin screw driven by a motor. Furthermore, the control device is further configured to supply toner within the reserve tank to the developing equipment by rotating the fin screw as driving the motor when whether the toner density is equal to or less than a first reference value is determined and the toner density is less than the first reference value; and determine whether the toner density is greater than a second reference value and continues a development of the image on the photoreceptor by the developing equipment when the toner density is greater than the second reference value and stops the development when the toner density is equal to or less than the second reference value.

Thus, the image forming apparatus and the toner refilling method for the image forming apparatus have an advantage to enable a smooth exchange of a toner cartridge without stopping operation of a main body of the image forming apparatus using a two-component developer. Moreover, it has an advantage that the toner supply is appropriately performed with a simple apparatus without the necessity of arranging a toner quantity detecting mechanism in the toner cartridge or in the reserve tank.

BRIEF DESCRIPTION OF THE DRAWINGS

A more complete understanding of this application can be obtained when the following detailed description is considered in conjunction with the following drawings, in which.

DETAILED DESCRIPTION

Figure 1:
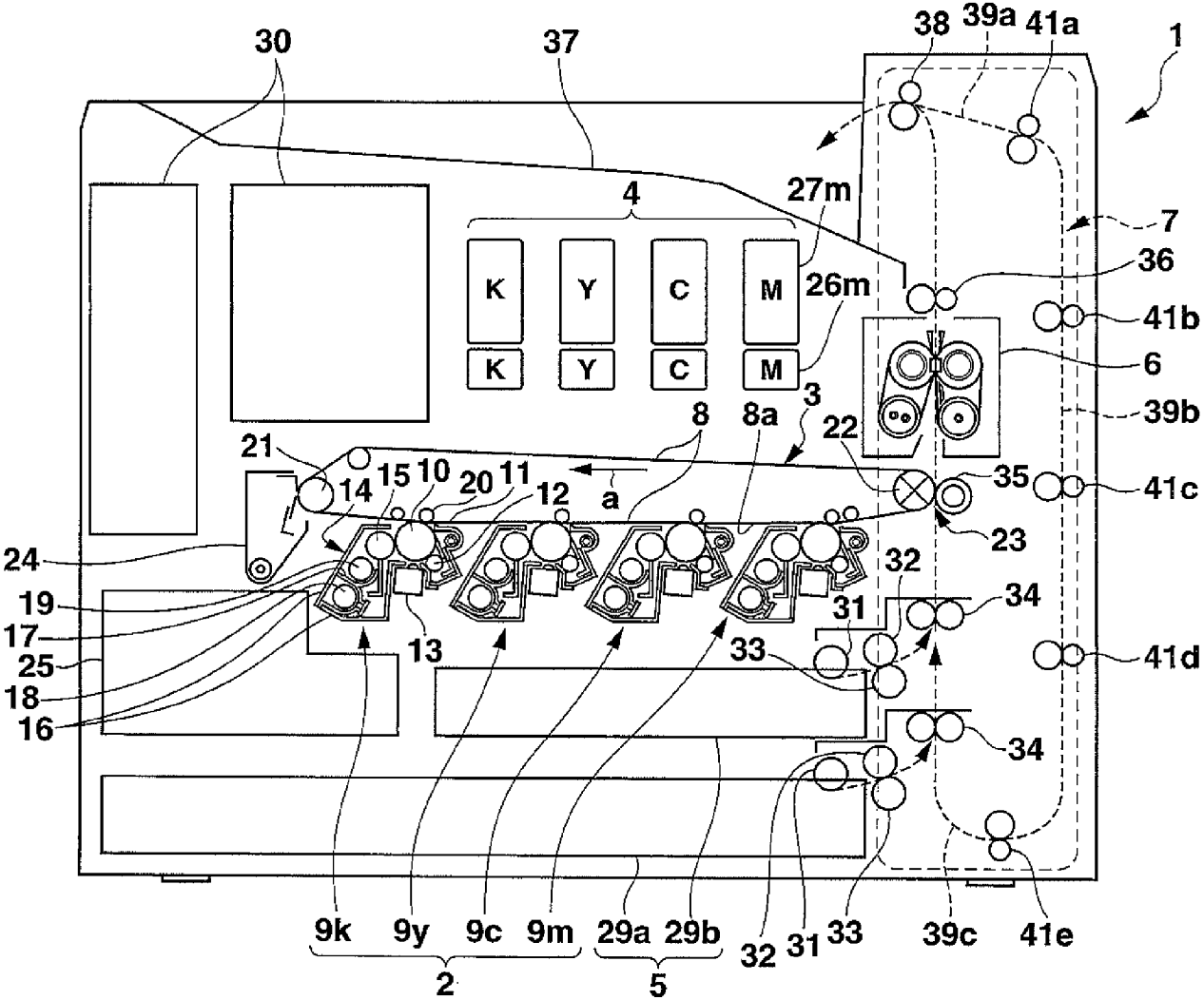
FIG. 1 is a cross-sectional view explaining the internal configuration of a full-color image forming apparatus (printer) concerning an embodiment.

The embodiment will be described below in details referring to the drawings. A two-component developer including toner and carrier is used in the embodiment described below, but the two-component developer is simply referred to as toner in the following explanation.

FIG. 1 is a cross-sectional view explaining the internal configuration of a full-color image forming apparatus (hereinafter, referred to as a printer) concerning the embodiment.

A printer 1 shown in FIG. 1 is a color image forming apparatus which is an electrophotographic type, a secondary transfer manner and a tandem type. The printer 1 is configured by an image forming section 2, a transferring belt unit 3, a toner supplying section 4, a sheet feeding section 5, a belt-type fixing unit 6 and a conveying unit 7 for both side printing.

The above-mentioned image forming section 2 has an configuration in which four developing devices 9 (9*m*, 9*c*, 9*y*, 9*k*) are provided side by side in a multistage manner from the right to the left in the figure, in contact with the lower running section surface 8*a* of the transferring belt 8 of the transferring belt unit 3. The image forming section 2 is held at the frame shown in FIG. 1 of the printer 1 main body capable of rising and falling from a position of a print execution time to a maintenance position which is lower than the position.

The three developing devices 9*m*, 9*c*, and 9*y* on a downstream (right-hand side of the figure) among the above-mentioned four developing devices 9 form a mono-color image by color toner of the magenta (M), the cyan (C) and the yellow (Y), which are the three primary colors of a subtractive color mixing. The developing device 9*k* forms a monochrome image by the black (K) toner mainly used for characters, the dark part of the image and so on.

Each of the above-mentioned developing devices 9 has the same configuration altogether except for the color of the toner for developing the image. Therefore, the developing device 9*k* for the toner of black (K) is taken as an example in the following, and the configuration thereof will be described.

The developing device 9 has a photosensitive drum 10 at the top thereof. A circumferential surface of the photosensitive drum 10 is configured by organic light conductivity materials, for example. A cleaner 11, a charging roller 12, an optical writing head 13, a developing roller 15 of a developing equipment 14 are arranged around a vicinity of the circumferential surface of the photosensitive drum 10.

The developing equipment 14 has a casing 16 which covers the developing equipment 14 along the outline, a partition 17 provided in an inner part, the developing roller 15, a first churning conveyance screw 18 and a second churning conveyance screw 19. The first and second churning conveyance screws 18 and 19 are configured by a screw shaft and a fin which is integrally configured with the screw shaft and rotate along with the screw shaft, which are not illustrated in particular.

Any toner of magenta (M), cyan (C), yellow (Y), and black (K), which are shown as M, C, Y, and K in the figure is supplied to the developing equipment 14 from a reserve tank, which will be described in detail below, of the toner supplying section 4.

The transferring belt unit 3 has an above-described transferring belt 8 which is end-less type and extends in a loop fashion flattened in left-and-right direction in FIG. 1 on nearly center of a body apparatus, a driving roller 21 which is wound the transferring belt 8 and causes the transferring belt 8 to circularly move in a counterclockwise direction indicated by an "arrow a" in FIG. 1, and a driven roller 22.

In the above-mentioned transferring belt 8, a toner image is directly transferred (primary transfer) on a belt surface circularly moving lower side thereof by a primary transferring roller 20. The primary transferring roller 20 is embedded integrally with a unit and is contacted by pressure to the photosensitive drum 10 through the transferring belt 8. The transferring belt 8 conveys the toner image to a secondary transferring section 23 to a sheet in order to further transfer (secondary transfer) to the sheet.

The transferring belt unit 3 is provided with a belt cleaner 24 having a cleaning blade which abuts a surface of the transferring belt 8 wound to the driving roller 21. A waste toner recycling container 25 is arranged at the lower side of the belt cleaner 24 so that it can be fitted and removed.

The cleaning blade of the belt cleaner 24 abuts the surface of the transferring belt 8 to rub off and remove a waste toner, the waste toner is sent to the waste toner recycling container 25 located on lower side by a conveying screw.

The toner supplying section 4 is configured by four reserve tanks 26 (26*m*, 26*c*, 26*y*, 26*k*) arranged on upper side of an upper running section of the transferring belt 8, and toner cartridges 27 (27*m*, 27*c*, 27*y*, 27*k*) for toner refilling, which are arranged above these reserve tanks 26 so that it can be fitted and removed, respectively.

The four toner cartridges 27*m*, 27*c*, 27*y*, and 27*k* accommodate the toner of magenta (M), cyan (C), yellow (Y), and black (K), respectively, and the four reserve tanks 26 (26*m*, 26*c*, 26*y*, 26*k*) are supplied toner from the toner cartridges 27, respectively.

Although it does not appear in FIG. 1 (hidden behind the transferring belt unit 3), the four reserve tanks 26 are connected, respectively, to the developing equipments 14 of the corresponding developing devices 9 via toner supplying lines.

The toner supplying section 4, not illustrated, is held at the frame of the printer 1 main body so that the toner supplying section 4 can rise and fall from the position of a print execution time shown in FIG. 1 to a maintenance position, the maintenance position is placed higher than the position of a print execution time.

At a left side of the toner supplying section 4, two electric equipment sections 30 are provided in a space from a left side of the belt cleaner 24 to an upper side of the driving roller 21. The electric equipment sections 30 have a circuit board on which a control device configured by plural electronic components is mounted, described in detail below.

The sheet feeding section 5 has two sheet feeding cassettes 29 (29*a*, 29*b*) arranged one above the other. A sheet extraction roller 31, a feeding roller 32, a handling roller 33 and a standby conveyance roller pair 34 are arranged at a vicinity of sheet feeding ports (right side in FIG. 1) of the two sheet feeding cassettes 29.

A secondary transferring roller 35 contacted by pressure with the driven roller 22 via the transferring belt 8 is arranged in a sheet conveying direction (vertically upper direction in FIG. 1) of the standby conveyance roller pair 34, it forms the above-mentioned secondary transferring section 23 to the sheet.

The belt-type heat-fixing unit 6 is arranged on downstream (upper side in FIG. 1) of the secondary transferring section. Further downstream of the belt-type heat-fixing unit 6, a discharge roller pair 36 and a sheet-discharging roller pair 38 are arranged. The discharge roller pair 36 discharges the sheet applied the fixing from the belt-type heat-fixing unit 6. The sheet-discharging roller pair 38 outputs the discharged sheet to a sheet-discharging tray 37 formed on an upper surface of the apparatus.

The conveying unit 7 for both sides printing doubles as an opening-and-closing member, outer surface (outer lateral surface on the right side in FIG. 1) of which opens and shields the inner part of the printer 1 outward from the lateral surface thereof.

This conveying unit 7 for both sides printing is provided with the return path 39. The return path 39 is configured by a start return path 39*a* which is branched in the right side direction in FIG. 1 at just before the sheet-discharging roller pair 38, an intermediate return path 39*b* which curves downward therefrom, and a termination return path 39*c* which curves toward a left side direction opposite to the above-mentioned direction and finally causes a return sheet to turn around.

Moreover, five pairs of return roller pairs 41 (41*a*, 41*b*, 41*c*, 41*d*, 41*e*) are arranged on the return path 39. The outlet of the above-mentioned termination return path 41*e* joins the conveying path to the standby conveyance roller pair 34 corresponding to the lower sheet feeding cassette 29*b* of the sheet feeding section 5.

Figure 2A:
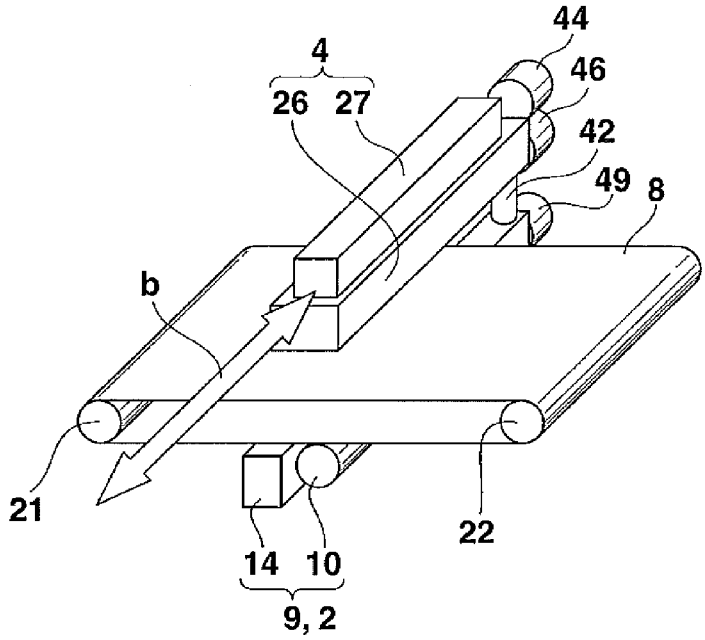
FIG. 2A is an exemplary figure showing a developing device of the printer, and a reserve tank and a toner cartridge of a toner supplying section, where only one of each reserve tank and toner cartridge is illustrated to help understanding, as well as a transferring belt.
Figure 2B:
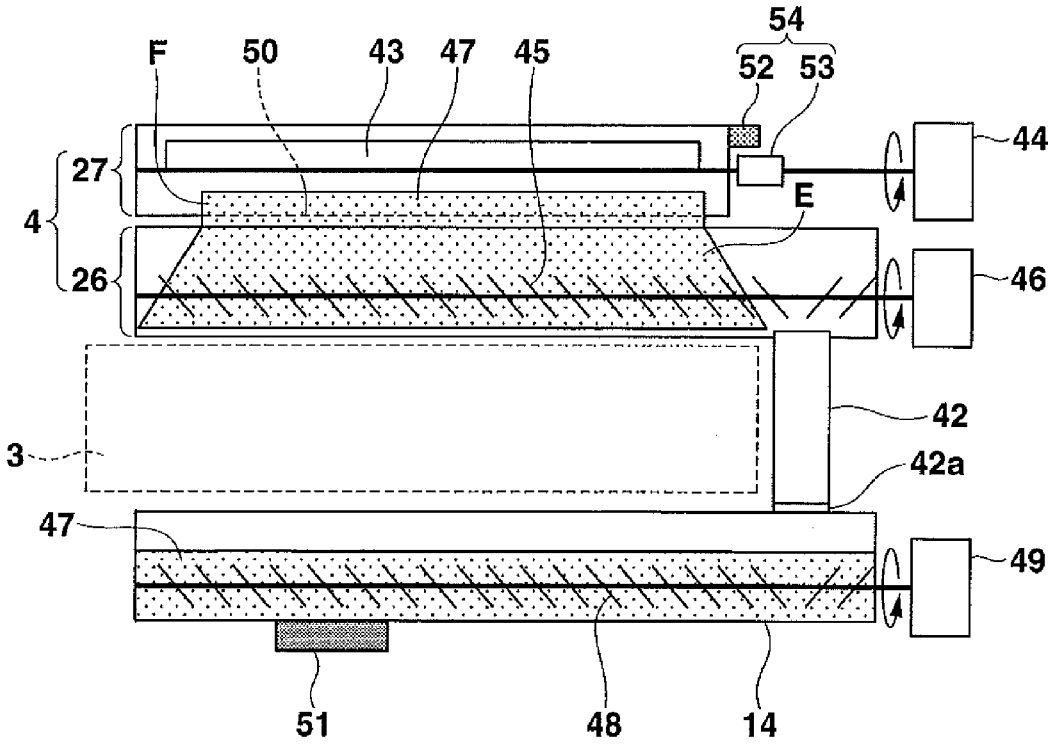
FIG. 2B is the cross-sectional view of the reserve tank, the toner cartridge and the transferring belt which are shown in FIG. 2A from a lateral view.

FIG. 2A is an exemplary figure showing the developing device 9 of the above-mentioned image forming device 2, the reserve tank 26 and a toner cartridge 27 of the toner supplying section 4 which are combined into only one unit in an easily understood manner, and a transferring belt 8. FIG. 2B is the cross-sectional view of them from a lateral view.

In FIG. 2A and FIG. 2B, the same numerals are provided as the numerals of in FIG. 1 for the same configuration or functional portion as the configuration shown in FIG. 1. Moreover, in FIG. 2B, the transferring belt unit 3 is shown as a block with the dashed line, replacing the transferring belt 8 in FIG. 2A.

The toner cartridge 27 shown in FIG. 2A and FIG. 2B is capable of fitting to and removing from the reserve tank 26 in the front direction to the image forming apparatus 1 main body shown in FIG. 1, that is, in the direction as shown by a both-directions arrow b in FIG. 2A.

The reserve tank 26 is connected with the developing equipment 14 through the toner conveying path 42 which is arranged so as to be wrapped around behind the transferring belt unit 3. The toner cartridge 27 has a toner supply mechanism 43 therein, and the toner supply mechanism 43 is engaged with a cartridge motor 44 from the outside.

When the toner cartridge 27 is mounted to a toner cartridge mounting section of the reserve tank 26, the toner cartridge 27 and the reserve tank 26 are connected so as to face an opening section 50. The toner cartridge 27 and the reserve tank 26 form an integrated toner tank through the opening section 50.

The opening section 50 constitutes nearly an entire area of the lower surface of the toner cartridge 27. According to this configuration, when the opening section 50 of the toner cartridge 27 is opened, toner 47 in a cartridge flows into the reserve tank 26 by gravity.

Furthermore, when the cartridge motor 44 rotates in order to fill the reserve tank 26 with the toner, the toner supply mechanism 43 in the toner cartridge 27 forcibly supplies the toner 47 into the reserve tank 26. In this manner, the toner 47 is accommodated in the reserve tank 26 in a filled state.

The reserve tank 26 has a fin screw 45 as the toner supply mechanism therein. A reserve tank motor 46 is connected with the fin screw 45. The reserve tank 26 conveys the toner 47 supplied from the toner cartridge 27 to the toner conveying path 42 by the fin screw 45 driven by the reserve tank motor 46.

The toner conveying path 42 is arranged so as to be wrapped around behind the transferring belt unit 3. A shutter member 42*a* is arranged on a lower end section of the toner conveying path 42 connected with the developing equipment 14.

The shutter member 42*a* is controlled so that a shutter is opened by a shutter opening-and-closing driving section, which is not illustrated, synchronizing with a toner supply operation of the fin screw 45 as the toner supply mechanism of the reserve tank 26, and the shutter is closed synchronizing with stopping the toner supply operation of the toner supply mechanism.

In the toner supply operation by the fin screw 45, the toner 47 is conveyed to a right side end in FIG. 2B. Then, the toner 47 falls by gravity from top to the bottom of the toner conveying path 42. Thereby, the toner 47 is supplied to the developing equipment 14 from the reserve tank motor 46.

The developing equipment 14 has a fin screw 48 as a toner churning conveyance mechanism therein. Besides, the first churning conveyance screw 18 and the second churning conveyance screw 19 which are shown in FIG. 1 are illustrated as one fin screw 48 in FIG. 2B.

A developing equipment motor 49 is connected with the fin screw 48. The developing equipment 14 supplies the toner 47 (in this case, the toner separated from the carrier) to the developing roller 15, while conveying the toner 47 with churning by the fin screw 48 driven by the developing equipment motor 49. A toner density sensor 51 is arranged outer bottom of the developing equipment 14.

In one embodiment, the two-component developer treats the carrier and the toner 47 separately. The carrier applies a mixed churning of the toner in the developing equipment 14, and charges the toner a predetermined amount of electric charge. The charged toner temporarily adheres on a surface of the carrier, and covers the surface of the carrier.

The carrier of the toner 47 conveyed in rotary manner by the developing roller 15 carries the charged toner to a facing position of the photosensitive drum 10 and the developing roller 15, and causes the toner to be transferred onto the electrostatic latent image on the photosensitive drum 10 to develop the toner image on the electrostatic latent image. After the carrier releases the toner on the surface, the carrier returns from the developing roller 15 into the developing equipment 14.

The carrier having returned into the developing equipment 14 may be used repeatedly, such that the carrier applies the mixed churning with new toner, charges the toner, and carries the toner onto the photosensitive drum 10. When the toner is running low in the developing equipment 14 (that is, a toner density becomes low), the toner may be replenished.

The magnetic adsorption performance and the charge performance of the carrier deteriorates as the above-mentioned carrier is used. When these performances have deteriorated, some problems may arise that cause a deterioration of images, such as an insufficiency of image density and an overlap of the image, in comparison with an initial image prior to the deterioration.

A trickle development extends an operating life of a developing device by replacing an old carrier having inferior performance due to deterioration with a new carrier to increase an adhesion performance of the toner. When supplying the toner to the developing equipment 14, in one embodiment, the trickle development replaces the old carrier with a new carrier.

The image forming section 2 of this example also performs the trickle development. Therefore, a magnetic permeability sensor is used for the toner density sensor 51 shown in FIG. 2B. This magnetic permeability sensor is commonly used as a toner density sensor for detecting the fact of running low on the toner in developing equipment in two-component development.

In the two-component development, the toner is a nonmagnetic substance whereas the carrier is a magnetic substance. If a magnetic permeability sensor senses the two-component developer, which combines the carrier and the toner, a sensor output value can be obtained having a certain ratio by weight.

Moreover, as shown in FIG. 2B, a detected section 52 which indicates a state of old and new is arranged on the toner cartridge 27. A detecting section 53 which detects a state of old and new of the toner cartridge 27 with the detected section 52 is arranged on the printer 1 main body side. Such detecting device 54 which detects the state of old and new of the toner cartridge 27 can be configured in general manner.

Figure 3:
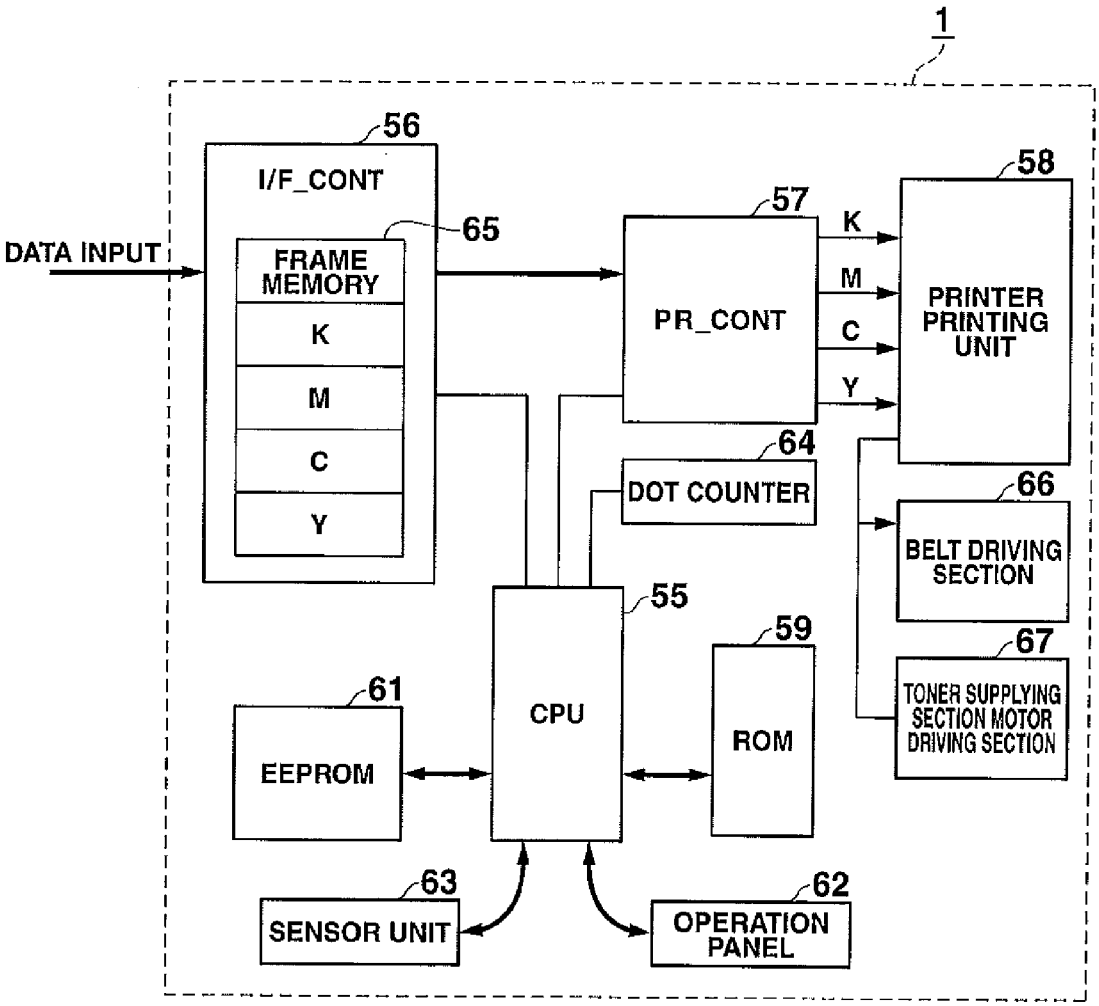
FIG. 3 is a circuit block diagram including a control device of the printer concerning the embodiment.

FIG. 3 is a circuit block diagram including a control device of the above-mentioned printer 1. In a circuit block as shown in FIG. 3, centering on CPU (central processing unit) 55, an interface controller (I/F_CONT) 56 and a printer controller (PR_CONT) 57 are connected to the CPU 55, respectively, through a data bus. A printer printing unit 58 is connected to PR_CONT 57.

Moreover, the CPU 55 is connected with ROM (read only memory) 59, EEPROM (electrically erasable programmable ROM) 61, operation panel 62 of a main body operation section, a sensor unit 63 which inputs the output of the sensor arranged in each section and a dot counter 64. Moreover, the operation panel 62 includes a display function for informing the user of information.

A system program is stored in the ROM 59, and the CPU 55 performs processes by controlling each section according to this system program.

That is, in each part, first, the I/F_CONT 56 converts, for example, the printing data supplied, from a host equipment such as a personal computer into bit map data, and expands it to the frame memory 65. Storage areas are set for black (K), magenta (M), cyan (C) and Yellow (Y) in the frame memory 65, and data of each color is expanded to corresponding area.

The data expanded in the frame memory 65 is outputted to the PR_CONT 57, and is outputted to the printer printing unit 58 from the PR_CONT 57.

The printer printing unit 58 is an engine section and is controlled by the PR_CONT 57. The printer printing unit 58 includes a rotary driving system, which is not illustrated, including such as the photosensitive drum 10 and the primary transferring roller 20 shown in FIG. 1, the image forming section including an driven section such as the charging roller 12 and the optical writing head 13, and a driving section, which is not illustrated, driving an up-and-down movement of the transferring belt unit 3 and a rotation of the transferring belt 8.

Furthermore, the printer printing unit 58 comprises a belt driving section 66 which performs belt driving for the belt-type fixing unit 6, and a toner supplying section motor driving section 67 which drives the cartridge motor 44, the reserve tank motor 46 and the developing equipment motor 49 and so on.

Furthermore, the printer printing unit 58 controls a drive output to process loads of a conveying mechanism configured by each of sections which are applied a rotary driven, such as sections from the sheet extraction roller 22 to the sheet-discharging roller pair 38 and the belt-type fixing unit 6 which have a heat driven and a rotary driven.

Then, the data of respective colors of the black (K), magenta (M), cyan (C), and yellow (Y), which are outputted from the PR_CONT 57, are supplied from the printer printing unit 58 to corresponding optical writing head 13 shown in FIG. 1, respectively.

Moreover, the dot counter 64 calculates the amount of the toner used for printing based on an exposure area to the photosensitive drum 10 by the optical writing head 13 according to the data of respective colors which are supplied to the optical writing head 13.

Figure 4:
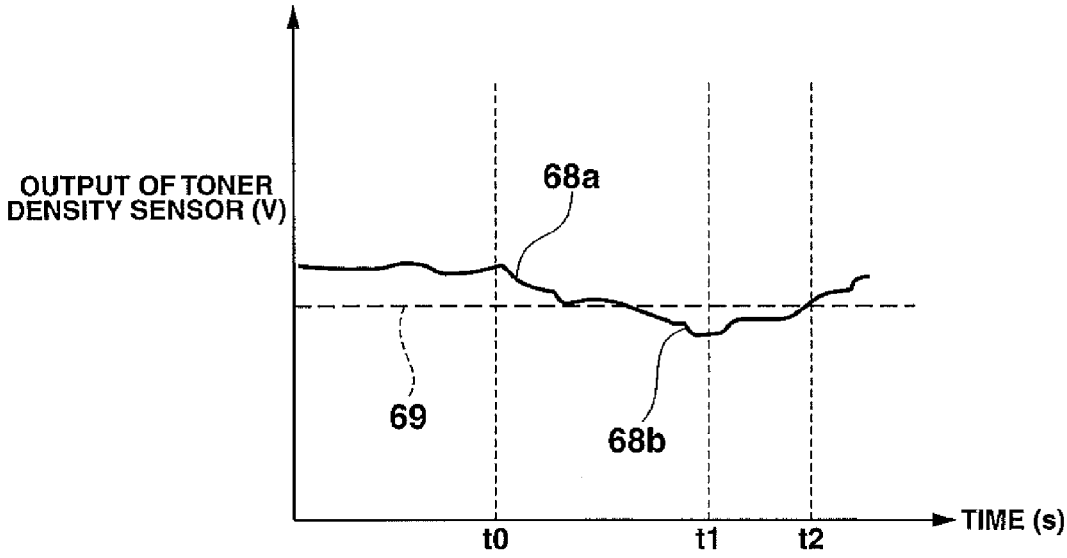
FIG. 4 is a figure showing an output example from a toner density sensor of the printer concerning the embodiment.

FIG. 4 is a figure showing an output example of the above-mentioned toner density sensor 51. The figure plots voltage as a function of time. The time (second (s)) is shown on a horizontal axis, and the output (voltage (V)) of the toner density sensor 51 is shown on the vertical axis. The graph 68 (68*a*, 68*b*) with the solid line shows a change of the output value of the toner density sensor 51.

Here, in order to explain the output of the toner density sensor 51, the two-component developer is reconsidered as the carrier and the toner, separately. In the case of a large amount of toner, the magnetic permeability of the two-component developer decreases, and the output value of the magnetic permeability sensor, that is, the toner density sensor 51 decreases. (In this example, the output is inverted so as to rise as the toner density decreases. Refer to the part of the graph 68*a* of FIG. 4.)

On the other hand, in the case of a small amount of toner, the magnetic permeability of the two-component developer increases, and the output value of the magnetic permeability sensor, that is, of the toner density sensor 51 increases. (In this example, the output is inverted so as to fall. Refer to the part of the graph 68*b* of FIG. 4.) Therefore, the output value of the toner density sensor 51 corresponding to the predetermined developer density is preliminary set as a threshold value (value shown with the dashed line 69 in FIG. 4) in the control device.

Then, the amount of the decreased toner is detected due to the fall of the output value of the magnetic permeability sensor, that is, of the toner density sensor 51. Then, the reserve tank motor 46 rotates, and the toner (in this case, the two-component developer which is configured by the carrier and the toner) is supplied to the developing equipment 14 from the reserve tank 26. If the output value of the toner density sensor 51 reaches the threshold value, the reserve tank motor 46 is stopped, and the toner supply is discontinued.

Figure 5:
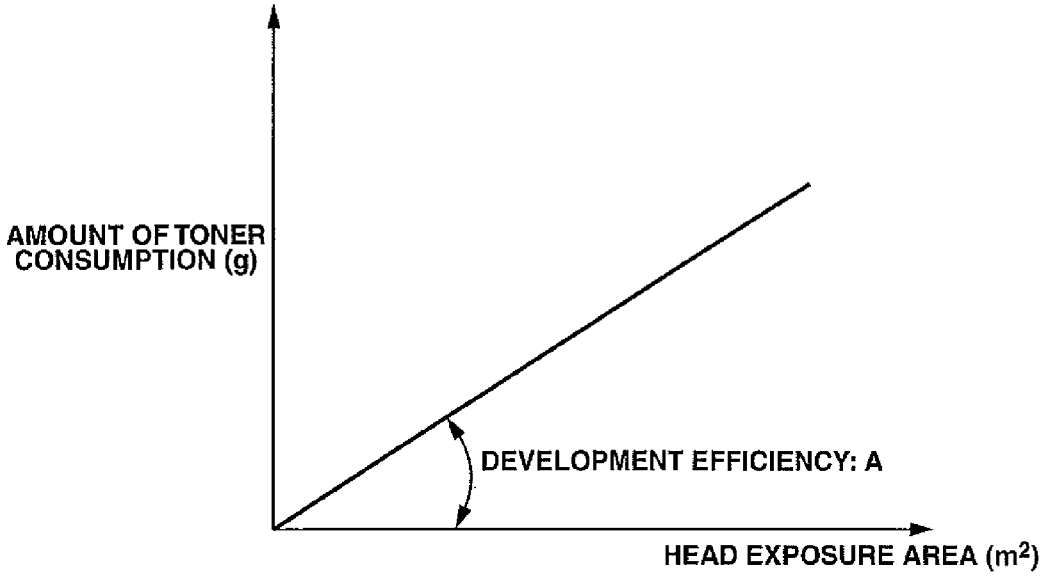
FIG. 5 is a figure explaining a toner amount calculation method of a dot counter of the printer concerning the embodiment.

FIG. 5 is a figure for explaining a toner amount calculation method of the above-mentioned dot counter 64. Furthermore, FIG. 5 illustrates the exposure area (m^2) to the photosensitive drum 10 by the optical writing head 13 on a horizontal axis, and illustrates the amount of toner consumption, (g), on the vertical axis. In other words, FIG. 5 shows a relation between the amount of toner consumption and the amount of light exposure by the optical writing head 13.

In one embodiment, a residual toner quantity detecting apparatus is not arranged inside the toner cartridge 27 or inside the reserve tank 26. Instead, the amount of toner consumption is determined by the dot counter 64 shown in FIG. 3 based on the characteristic figure shown in FIG. 5.

When a development efficiency against the fixed amount of light which the optical writing head 13 outputs is defined as A, the amount of toner consumption can be calculated from the relation of "the amount of toner consumption (g)=A multiplied by an exposure area (m^2)".

Figure 6:
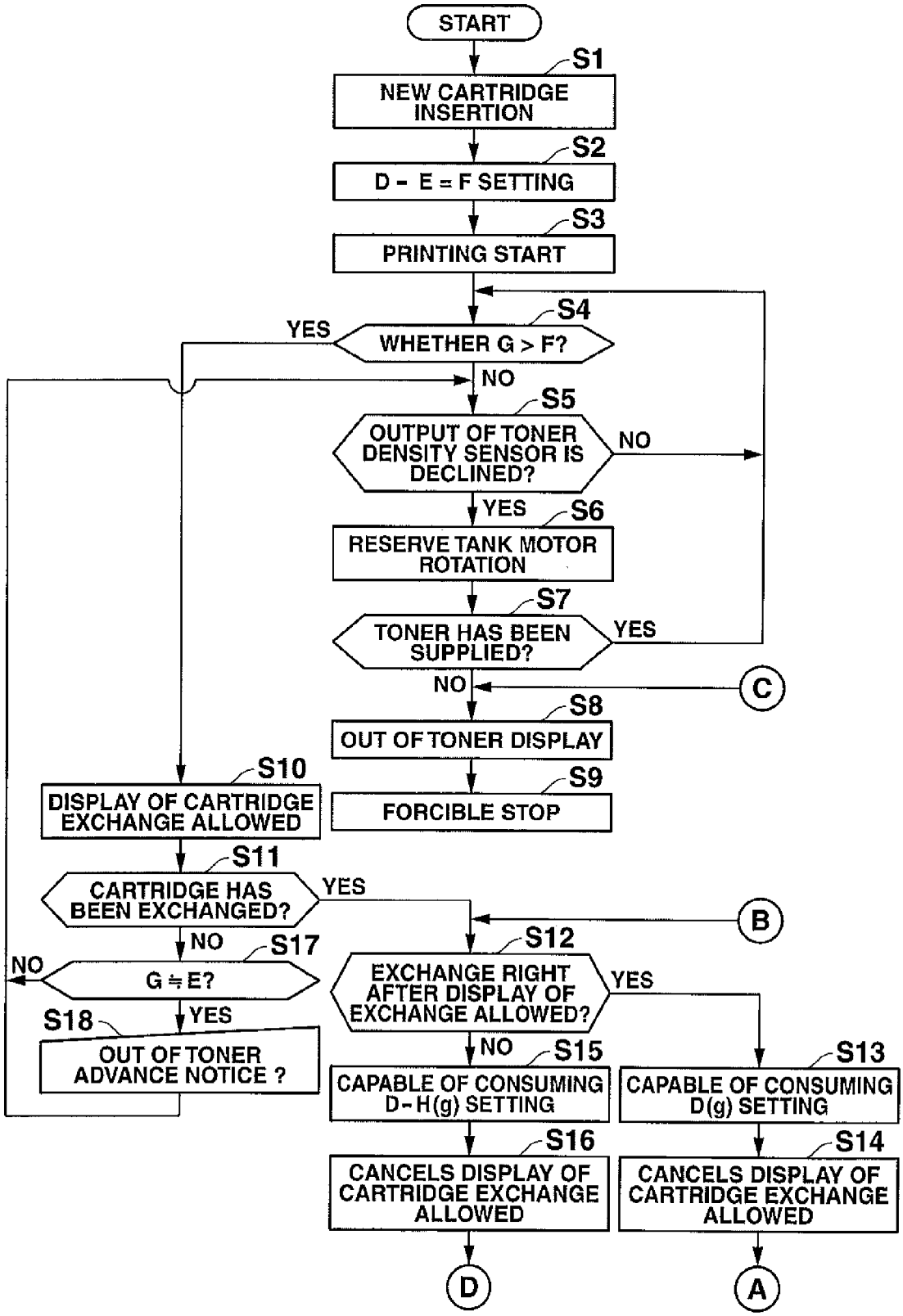
FIG. 6 is a flowchart (1) which shows operation of the toner refilling process by the control device of the printer concerning the embodiment.
Figure 7A:
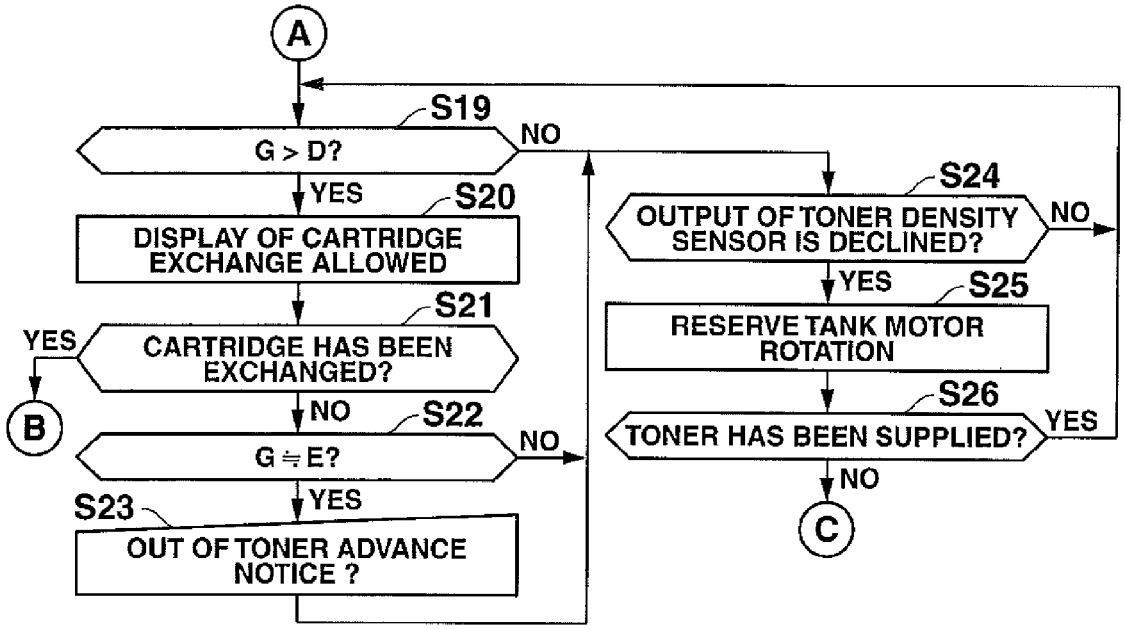
FIG. 7A is a flowchart (2) which shows operation of the toner refilling process by the control device of the printer concerning the embodiment.
Figure 7B:
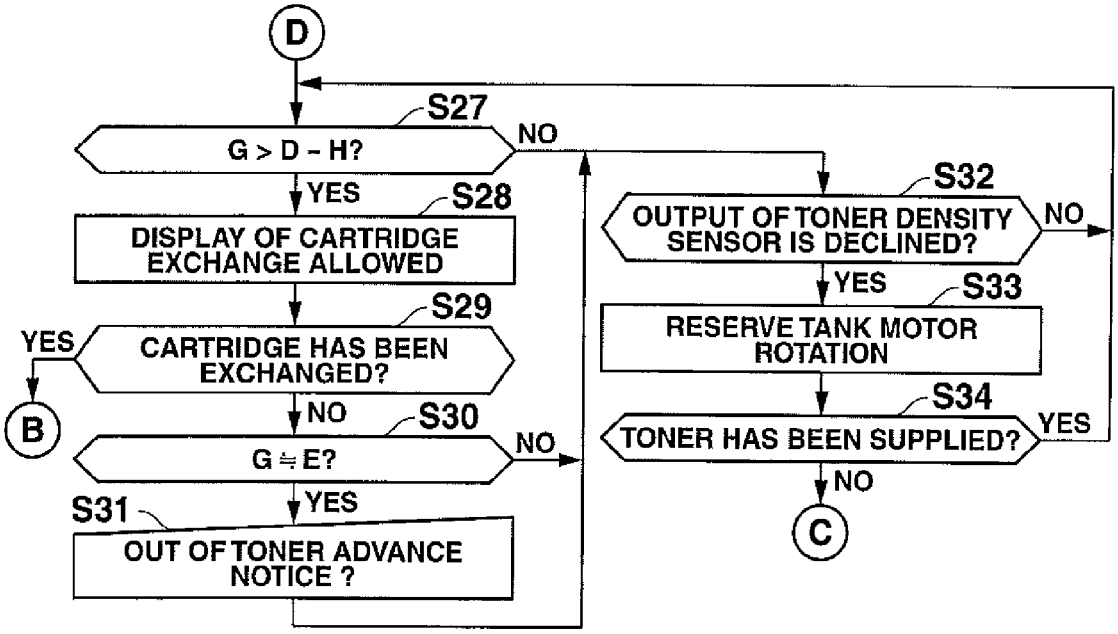
FIG. 7B is a flowchart (3) which shows operation of the toner refilling process by the control device of the printer concerning the embodiment.

FIG. 6, FIG. 7A and FIG. 7B are flowcharts which show operation of the toner refilling process by the CPU 55 of the control device shown in FIG. 3 of the printer 1 in the above-mentioned configuration. Besides, in the following process, the amount of toner put in the toner cartridge 27 is defined as the amount of filling toner D, and the amount of toner which fills the reserve tank 26 is defined as the amount of full accommodation toner E (units are in grams).

Moreover, the amount of toner which remains in the toner cartridge 27 after having filled the reserve tank 26 is defined as the amount of remaining surplus toner F, the amount of toner calculated by the dot counter 64 within a time range from an exchange of old and new of the toner cartridges 27 to the present is defined as the amount of toner consumption G, and the amount of toner used and/or consumed (units are in grams) in the period from an old and new exchange-instruction of the toner cartridge 27 informing to exchange to a new toner cartridge 27 is defined as the amount of toner consumption in an exchange period H.

Moreover, in one embodiment, in the process shown in FIG. 6, an unused toner 47 is premised to have fed into the developing equipment 14 wherein the toner 47 was not charged in the reserve tank 26 prior to shipment.

That is, FIG. 6 shows the toner refilling process during the printing process. Here, with respect to the printing process, initially there is no toner in the reserve tank 26 for the new printer 1, where unpacked. After the toner is charged in the new toner cartridge 27, the reserve tank 26 the printing process is started.

When the toner cartridge 27 having the amount of filling toner D is mounted to the reserve tank 26, some of the toner 47 in the toner cartridge 27 move to the reserve tank 26, and the reserve tank 26 maintains the amount of full accommodation toner E, and the toner cartridge 27 contains the amount of remaining surplus toner F which has not yet been moved into the reserve tank 26.

That is, it is D=E+F. This can be calculated by storing in advance the capacities of the reserve tank 26 and the toner cartridge 27 in the EEPROM 61 or the like of the control device. The above-mentioned formula will serve as D−E=F, if E is subtracted from both sides of the equation.

In FIG. 6, when starting the process, a new cartridge insertion is checked first (step S1). In this process, a fact that the new toner cartridge 27 is mounted is detected by old and new detecting device 54 shown in FIG. 2A, and then the detecting result is notified to the CPU 55 through the sensor unit 63.

The CPU 55 receives the notification of the new toner cartridge mounted confirmation, and thus, recognizes the fact that the toner 47 is charged in the reserve tank 26. Then, the CPU 55 calculates an equation D−E=F and stores a calculation result in the predetermined storage area of the EEPROM 61, for example (step S2). Moreover, the CPU 55 allows the developing equipment 14 to develop the toner image on the photosensitive drum 10.

Next, the CPU 55, according to the user instruction, outputs instructions to the I/F_CONT 56 and the PR_CONT 57 to start a printing (step S3). That is, an actual printing process is started from this timing. Besides, in this printing process, the CPU 55 requests the dot counter 64 to calculate the amount of toner consumption G of the toner 47 during printing process.

Subsequently, the CPU 55 determines, with reference to the dot counter 64, whether or not the amount of toner consumption G used during the printing process, in other words, the amount of toner consumption that the developing equipment 14 consumed between the time that a new toner cartridge is mounted and the current state exceeds the amount of remaining surplus toner F which is previously stored and set in the predetermined storage area of the EEPROM 61 (step S4).

Moreover, in the case where the amount of toner consumption G does not exceed the amount of remaining surplus toner F (the determination in S4: No), the CPU 55 determines whether or not the output of the toner density sensor 51 has declined (step S5), subsequently. This process is a process to determine whether or not the output value 68 of the toner density sensor 51 shown in FIG. 4 falls below the threshold value 69.

Then, in the case where the output value 68 does not fall below the threshold value 69 (the determination in S5: No), the CPU 55 returns to the step S4 and repeats the processes of the steps S4 and S5.

In due course, in the case where the output value 68 falls below the threshold value 69 in the determination of the step S5 (the determination in S5: Yes), the CPU 55 applies a rotation control to the reserve tank motor 46 to cause it to carry out a rotary drive for the fin screw 45, and causes the toner 47 to supply from the reserve tank 26 to the developing equipment 14 (step S6).

Then, the CPU 55 determines whether or not the toner 47 has been supplied normally to the developing equipment 14 (step S7). For example the graph shown by the graph 68*b* in FIG. 4, this process determines using the output value 68 of the toner density sensor 51 which has declined below a value, t1, and then increases over the threshold value 69, t2.

Then, in the case where it is determined that the toner 47 has been supplied normally to the developing equipment 14 (the determination in S7: Yes), it stops the rotation of the reserve tank motor 46, returns to the step S4, and repeats the processes of the steps S4 and S5 again. In this way, the printing can be continued while performing the toner supply so that a minimum predetermined developer density may be maintained.

In due course, in the case where the step S4 determines that the amount of toner consumption G exceeds the amount of remaining surplus toner F (the determination in S4: Yes), the CPU 55 judges that all the remaining surplus toner in the toner cartridge 27 has been moved to the reserve tank 26, and informs an exchange to the user to carry out the exchange of old and new toner cartridges (step S10). Here, the CPU 55 exchange-informs the user while the image forming apparatus operates, for example, while the toner image is being developed on the photosensitive drum 10 by the developing equipment 14. Moreover, the CPU 55 may inform on the display device by displaying an instruction on the display device such as the operation panel 62.

In this way, while recognizing the amount of consumption of the toner 47 used by the printing using the dot counter 64, it promptly display-informs, for example on the operation panel 62, "toner cartridge exchange is allowed", or the like, at the phase where only toner 47 in the toner cartridge 27 has been consumed, thereby avoiding to be a state of zero-toner.

Thus, it is possible to secure the printing operation by the user by the exchange of the toner cartridge 27. Moreover, this display informing of "toner cartridge exchange is allowed" does not require to arrange an apparatus for a toner residual quantity detection or the like in the toner cartridge 27 and the reserve tank 26, and also allows to provide a printer which is capable of performing stabilized printing operation at a low price.

Following the above, the CPU 55 determines whether or not the old toner cartridge 27 has been exchanged to the new toner cartridge 27 (step S11). This process is a process to wait a notification of detecting the new toner cartridge 27 from the detecting device 54.

Then, in the case where the CPU 55 receives the notification of detecting the new toner cartridge 27 from the detecting device 54 (the determination in S11: Yes), the CPU 55 determines whether or not the detecting notification indicates the exchange nearly right after the display informing of "toner cartridge exchange is allowed" (step S12).

According to this determination, in the case where the detecting notification is nearly right after the display informing of "toner cartridge exchange is allowed" (the determination in S12: Yes), the CPU 55 recognizes that the amount of filling toner D of the toner cartridge 27 is further added to the amount of full accommodation toner E in the reserve tank 26.

Therefore, the CPU 55 provides feedback to the dot counter 64 that the toner 47 of the amount of filling toner D can be consumed by the exchange to following toner cartridge 27 that is, before the toner cartridge 27 now mounted becomes empty (step S13).

Thus, the dot counter 64 recognizes an exchange time for the next toner cartridge 27 when the amount of consumption of the toner 47 has exceeded the amount of filling toner D, and notifies the CPU 55 of the exchange time.

Subsequently, the CPU 55 removes the display of "toner cartridge exchange is allowed" (step S14), and then proceeds to the process A of FIG. 7A.

On one hand, according to the determination in the step S12, in the case where the detecting notification from the detecting device 54 indicates that it has passed a certain time from the timing of the display informing of "toner cartridge exchange is allowed" (the determination in S12: No), the CPU 55 judges that the toner in the reserve tank 26 has been consumed from the amount of full accommodation toner E, that is, the amount of toner consumed in an exchange period H.

In this case, the CPU 55 acknowledges that, with respect to the amount of full accommodation toner E in the reserve tank 26, the amount of filling toner D of the toner cartridge 27 is added after further consuming the amount of toner consumption in an exchange period H.

Therefore, the CPU 55 provides feedback to the dot counter 64 that the toner 47 of D-H can be consumed by prior to the exchange of the toner cartridge 27, that is, before the toner cartridge 27 now mounted becomes empty, the D-H being subtracted amount of toner consumption in an exchange period H that may be moved to the reserve tank 26 from the filling toner D (step S15). Moreover, the CPU 55 may inform the user on the display device of D-H.

Thus, the dot counter 64 is aware of the exchange time for the toner cartridge 27 when the amount of consumption of the toner 47 has exceeded the "D-H", and prepares to notify the CPU 55 of the exchange time.

Subsequently, the CPU 55 cancels the display informing of "toner cartridge exchange is allowed" (step S16), and then proceeds to the process D of FIG. 7B.

On the other hand, in the determination in the step S11, if there is no notification of detecting the new toner cartridge 27 from the detecting device 54 (the determination in S11: No), then the CPU 55 determines whether or not the amount of toner consumption G approaches and is close to the amount of full accommodation toner E, or whether or not a difference between the amount of consumption of the toner and the amount of full accommodation toner is equal to or less than a predetermined reference value (step S17).

Then, in the case where the amount of toner consumption G is not close to the amount of full accommodation toner E (the determination in S17: No), the CPU 55 returns to the step S5, and repeats the processes of the steps S5, S6, S7, S4, S10, S11 and S17.

In due course, in the case where it becomes "(the amount of toner consumption G) is nearly equal to (the amount of full accommodation toner E)" in the determination in the step S17 (the determination in S17: Yes), the CPU 55 carries out an advance-notice-display-informing of "out of toner", for example, on the operation panel 62 (step S18), returns to the step S5, and repeats the processes of the steps S5, S6, S7, S4, S10, S11, S17, S18, S5, S6, and S7.

In due course, in the case where the CPU 55 determines in the determination in the step S7 that the output value 68 of the toner density sensor 51 does not increase over the threshold value 69, that is, the toner 47 goes out of supply to the developing equipment 14 (the determination in S7: No), the CPU 55 display-informs of "out of toner" on a display device (step S8), and causes the operation of the printer 1 main body to forcibly stop (step S9).

Thus, when the user ignores the display informing of "toner cartridge exchange is allowed", and continues the printing operation, thereby stopping the supply of the toner 47 to the developing equipment 14, the operation of the printer 1 main body is forcibly stopped as it becomes unlikely to print a normal image.

Next, the process A shown in FIG. 7A will be described. In the process A, the CPU 55 determines whether or not there is an indication for the exchange time of the toner cartridge 27 from the dot counter 64, that is, whether or not it becomes a state "(the amount of toner consumption G)>(the amount of filling toner D of the toner cartridge)" (step S19).

Then, in the case where there is no notification of the exchange time (the determination in S19: No), the CPU 55 determines whether or not the output value 68 of the toner density sensor 51 shown in FIG. 4 falls below the threshold value 69 (step S24).

Accordingly, in the case where the output value 68 does not fall below the threshold value 69 (the determination in S24: No), the CPU 55 returns to the step S19 and repeats the processes of the steps S19 and S24, subsequently.

In due course, in the case where the output value 68 falls below the threshold value 69 in the determination in the step S24 (the determination in S24: Yes), the CPU 55 performs a rotation control of the reserve tank motor 46 to rotary drive the fin screw 45. Thereby, the toner 47 is supplied from the reserve tank 26 to the developing equipment 14 (step S25).

Then, the CPU 55 determines whether or not the toner 47 has been normally supplied to the developing equipment 14, that is, whether or not the output value 68 of the toner density sensor 51 which has fallen to a position shown in the graph 68*b* of FIG. 4 has increased over the threshold value 69 (step S26).

Then, in the case where it is determined that the toner 47 has been normally supplied to the developing equipment 14 (the determination in S26: Yes), the CPU 55 causes the rotation of the reserve tank motor 46 to stop, returns to the step S19 and repeats the processes of the steps S19 and S24. In this way, after exchanging the toner cartridge 27, it is possible to continue the printing, while supplying toner so that the predetermined developer density may be maintained.

In due course, in the case where it is notified that it comes the exchange time of the toner cartridge 27 from the dot counter 64 in the determination in the step S19 (the determination in S19: Yes), the CPU 55 determines that all of the remaining surplus toner in the toner cartridge 27 has moved into the reserve tank 26, and exchange-informs the user to perform the exchange of old and new toner cartridges again (step S20).

Following the above, the CPU 55 waits for a notification from the detecting device 54 that it has detected the new toner cartridge 27, replacing the old toner cartridge 27 (step S21). In the case of receiving the notification from the detecting device 54 that it has detected the new toner cartridge 27 (the determination in S21: Yes), the CPU 55 proceeds to the process B of FIG. 6.

On the other hand, in the case of not receiving the notification from the detecting device 54 that it has detected the new toner cartridge 27 in the determination in the step S21 (the determination in S21: No), then the CPU 55 determines whether or not the amount of toner consumption G approaches and is close to the amount of full accommodation toner E (step S22).

Then, in the case where the amount of toner consumption G is not close to the amount of full accommodation toner E (the determination in S22: No), the CPU 55 returns to the step S24, and repeats the processes of the steps S24, S25, S26, S19, S20, S21 and S22.

In due course, in the case where it becomes "(the amount of toner consumption G) is nearly equal to (the amount of full accommodation toner E)" in the determination in the step S22 (the determination in S22: Yes), the CPU 55 carries out the advance-notice-display-informing of "out of toner" (step S23), returns to the step S24, and repeats the processes of the steps S24, S25, S26, S19, S20, S21, S22, S23, S24, S25 and S26.

In due course, in the case where the CPU 55 determines in the determination in the step S26 that the output value 68 of the toner density sensor 51 does not increase over the threshold value 69, that is, the toner 47 goes out of supply to the developing equipment 14 (the determination in S26: No), the CPU 55 proceeds to the process C of FIG. 6.

Next, the process D shown in FIG. 7B will be described. In the process D, the CPU 55 determines whether or not it is notified that it comes the exchange time of the toner cartridge 27 from the dot counter 64, that is, whether or not it becomes a state "(the amount of toner consumption G)>(the amount of filling toner D in the toner cartridge)−(the amount of toner consumption in an exchange period H)" (step S27).

Then, in the case where it is not notified that it comes the exchange time (the determination in S27: No), the CPU 55 proceeds to the step S32, subsequently. On the other hand, in the case where it is notified that it comes the exchange time (the determination in S27: Yes), the CPU 55 proceeds to the step S28.

The processes of the steps S32, S33 and S34 in this process D are same as the processes of the steps S24, S25 and S26 in the process A shown in FIG. 7A, and the processes of the steps S28, S29, S30 and S31 in the process D are same as the processes of the steps S20, S21, S22 and S23 in the process A shown in FIG. 7A.

Thus, the toner refilling method in the embodiment has the same function in the process after the toner refilling at the time of the first stage in the case that the printer 1 is a new article, and also in the process of the toner refilling after exchanging the toner cartridge 27.

That is, it is possible to continue the printing, while supplying toner so that the predetermined developer density may always be maintained, and by display-informing "toner cartridge exchange is allowed" at the time when all remaining toner in the toner cartridge 27 moves to the reserve tank 26 and the toner cartridge 27 becomes empty, it is possible to avoid to become a state of out of toner.

While recognizing the amount of consumption of the toner 47 used by the printing using the dot counter 64, it detects a period in which only toner 47 in the toner cartridge 27 is consumed, and display-informs "toner cartridge exchange is allowed" at this period, therefore, it is possible to secure the printing operation by the time of toner cartridge exchange.

The display informing of "toner cartridge exchange is allowed" enables to provide a printer which is capable of performing stabilized printing operation at a low price, without requiring to arrange an apparatus for a toner residual quantity detection or the like in the toner cartridge 27 and the reserve tank 26, Having described and illustrated the principles of this application by reference to one (or more) preferred embodiment(s), it should be apparent that the preferred embodiment(s) may be modified in arrangement and detail without departing from the principles disclosed herein and that it is intended that the application be construed as including all such modifications and variations insofar as they come within the spirit and scope of the subject matter disclosed herein.

What is claimed is:

1. A toner refilling method for an image forming apparatus which comprises (i) a reserve tank which is integrally provided in a main body of the image forming apparatus and which does not include a detection sensor that directly detects whether or not a toner exists inside the reserve tank; (ii) a two-component developing equipment which is detachably connected to the reserve tank and which develops an image on a photoreceptor with a two-component developer for printing; (iii) a toner density sensor which detects a density of the toner in the two-component developing equipment; and (iv) a toner cartridge which is detachably connected to the reserve tank and which supplies the toner to the two-component developing equipment via the reserve tank, wherein the toner cartridge does not include a detection sensor that directly detects whether or not the toner exists inside the toner cartridge, the toner refilling method comprising:

receiving a notification from a detecting device indicating that the toner cartridge which is an original toner cartridge is mounted on the reserve tank;

starting a printing in accordance with the notification of the mounting of the original toner cartridge;

determining an amount of remaining surplus toner remaining in the original toner cartridge by subtracting an amount of full accommodation toner for filling up the reserve tank from an amount of charged toner in the original toner cartridge;

acquiring an amount of toner consumption using a dot counter which counts total printing data from a printing start to a current state;

determining whether or not the amount of the toner consumption exceeds the amount of the remaining surplus toner, and when it is determined that the amount of the toner consumption exceeds the amount of the remaining surplus toner, exchange-informing a user to exchange the original toner cartridge with a new toner cartridge while operating the main body of the image forming apparatus;

waiting for a notification of detection of the new toner cartridge which replaces the original toner cartridge; and informing the user of an amount of toner which can be consumed after the exchange to the new toner cartridge and proceeding with the printing, when the notification of detection of the new toner cartridge is received.

2. The toner refilling method for the image forming apparatus according to claim 1, further comprising, when informing the user of the amount of toner which can be consumed: (i) calculating an amount of toner consumption in an exchange period in which the toner is supplied to the two-component developing equipment from the reserve tank within the time from the exchange-informing to informing the user, and (ii) informing the user of a value obtained by subtracting the amount of toner consumption in the exchange period from the amount of charged toner in the new toner cartridge as the amount of toner which can be consumed.

3. The toner refilling method for the image forming apparatus according to claim 1, further comprising, when the amount of toner consumption after the exchange-informing is close to the amount of full accommodation toner, and when the notification of detection of the new toner cartridge is not received from the detecting device, informing the user of an advance out of toner notice and proceeding with the printing.

4. The toner refilling method for the image forming apparatus according to claim 1, further comprising:

driving a reserve tank motor for toner supply of the reserve tank when an output of the toner density sensor decreases; and monitoring whether or not the output of the toner density sensor has recovered, and proceeding with the printing when the output has recovered, and forcibly stopping an operation of the main body of the image forming apparatus when the output has not recovered.

5. An image forming apparatus for printing on a paper, the image forming apparatus comprising:

a reserve tank that is integrally provided in a main body of the apparatus and that does not include a detection sensor which directly detects whether or not a toner exists inside the reserve tank;

a two-component developing equipment that is detachably connected to the reserve tank and that develops an image on a photoreceptor with a two-component developer for printing;

a toner density sensor that detects a density of the toner in the two-component developing equipment;

a toner cartridge that is detachably connected to the reserve tank and that supplies the toner to the two-component developing equipment via the reserve tank, wherein the toner cartridge does not include a detection sensor which directly detects whether or not the toner exists inside the toner cartridge;

a detecting device that detects a new toner cartridge being mounted;

a consumed toner amount calculation unit that calculates an amount of consumption of the toner consumed by the two-component developing equipment for printing based on printing data;

a control device that determines necessity of exchange of the new toner cartridge in the image forming apparatus according to the amount of consumption of the toner calculated by the consumed toner amount calculation unit; and a storage unit that stores an amount of remaining surplus toner remaining in the new toner cartridge, wherein the amount of remaining surplus toner is a difference between an amount of charged toner of the new toner cartridge mounted on the reserve tank and an amount of full accommodation toner from the new toner cartridge which fills up the reserve tank, wherein the control device is configured to:

display on a display device as consumable information, in response to a notification from the detecting device that the new toner cartridge is mounted on the reserve tank, and while the image is being developed on the photoreceptor by the two-component developing equipment, an indication of an amount of toner that is consumable until a next exchange of the new toner cartridge;

control a printing operation of the image forming devise apparatus according to a user instruction;

obtain the amount of toner consumption calculated by the consumed toner amount calculation unit as an amount of toner used in the two-component developing equipment from a time that the new toner cartridge is mounted to a current state; and display on the display device, while the image is developable on the photoreceptor by the two-component developing equipment, and when the amount of toner consumption exceeds the amount of remaining surplus toner stored in the storage unit, an instruction informing the user of exchange information that encourages the user to exchange the mounted new toner cartridge with another new toner cartridge.

6. The image forming apparatus according to claim 5, wherein the consumable information is information based on a difference between the amount of full accommodation toner and an amount of toner consumption in an exchange period, wherein the amount of toner consumption in the exchange period is an amount of toner supplied to the two-component developing equipment from the reserve tank after instruction of exchange information.

7. The image forming apparatus according to claim 5, wherein the control device further displays on the display device a user instruction of an advance out of toner notice, when a difference between the amount of consumption of the toner after the instruction of the exchange information and the amount of full accommodation toner is equal to or less than a predetermined reference value, and when the exchange from the mounted new toner cartridge with the another new toner cartridge is not detected and notified.

8. The image forming apparatus according to claim 5, wherein the reserve tank comprises a fin screw driven by a motor, and wherein the control device is further configured to:

supply the toner within the reserve tank to the two-component developing equipment by rotating the fin screw by driving the motor when the toner density sensor detects that the toner density is less than a first reference value; and continue a development of the image on the photoreceptor by the two-component developing equipment when the toner density sensor detects that the toner density is greater than a second reference value, and stop the development when the toner density sensor detects that the toner density is equal to or less than the second reference value.

* * * * *

UNITED STATES PATENT AND TRADEMARK OFFICE

CERTIFICATE OF CORRECTION

PATENT NO. : 8,666,264 B2
APPLICATION NO. : 13/150419
DATED : March 4, 2014
INVENTOR(S) : Fumio Shimazu It is certified that error appears in the above-identified patent and that said Letters Patent is hereby corrected as shown below:

In the Claims

Column 18, Line 56 (Claim 5, Line 46):

after “forming” delete “devise”.

Signed and Sealed this
Sixteenth Day of September, 2014

Michelle K. Lee

Michelle K. Lee
*Deputy Director of the United States Patent and Trademark Office*